US010987792B2

(12) United States Patent
Yoshikane et al.

(10) Patent No.: US 10,987,792 B2
(45) Date of Patent: Apr. 27, 2021

(54) IMPACT TOOL

(71) Applicant: MAKITA CORPORATION, Anjo (JP)

(72) Inventors: Kiyonobu Yoshikane, Anjo (JP); Yoshiro Tada, Anjo (JP); Mizuki Yamamoto, Anjo (JP)

(73) Assignee: MAKITA CORPORATION, Anjo (JP)

( * ) Notice: Subject to any disclaimer, the term of this patent is extended or adjusted under 35 U.S.C. 154(b) by 140 days.

(21) Appl. No.: 16/289,004

(22) Filed: Feb. 28, 2019

(65) Prior Publication Data

US 2019/0314971 A1 Oct. 17, 2019

(30) Foreign Application Priority Data

Apr. 11, 2018 (JP) ..... JP2018-076311
Dec. 26, 2018 (JP) ..... 2018-243287

(51) Int. Cl.
*B25D 17/24* (2006.01)
*B25D 11/06* (2006.01)
*B25D 11/04* (2006.01)

(52) U.S. Cl.
CPC ..... *B25D 17/24* (2013.01); *B25D 11/04* (2013.01); *B25D 11/064* (2013.01)

(58) Field of Classification Search
CPC .. B25D 17/24; B25D 2250/371; B25D 17/06; B25D 2222/57; B25D 11/125; B25F 5/006
USPC ..... 173/162.2, 162.1
See application file for complete search history.

(56) References Cited

U.S. PATENT DOCUMENTS 6,675,908 B1 * 1/2004 Frauhammer ..... B25D 11/125 173/137
8,037,947 B2 * 10/2011 Miwa ..... B25D 17/06 173/210
8,430,182 B2 * 4/2013 Soika ..... B25F 5/006 173/162.1
2010/0294525 A1 * 11/2010 Meixner ..... B25D 17/24 173/210

FOREIGN PATENT DOCUMENTS

JP 3369844 B2 1/2003

* cited by examiner

*Primary Examiner* — Michelle Lopez
(74) *Attorney, Agent, or Firm* — Oliff PLC

(57) ABSTRACT

An impact tool includes a tubular tool holder, a hammering mechanism, a resistor, and a biasing member. An impact element moves forward and rearward in conjunction with a piston. An intermediate element is housed movable back and forth between the impact element and a tip tool. The intermediate element abuts on a rear end of the tip tool to indirectly transmit a striking force from the impact element to the tip tool in a normal striking. The resistor is configured to abut on at least one of the intermediate element and the tip tool to apply a resistance to a front-rear movement of at least one of the intermediate element and the tip tool in a non-striking state. The biasing member disposed on the tool holder biases the resistor to a side of at least one of the intermediate element and the tip tool.

20 Claims, 8 Drawing Sheets

IMPACT TOOL

BACKGROUND

This application claims the benefit of Japanese Patent Application Number 2018-076311 filed on Apr. 11, 2018 and Japanese Patent Application Number 2018-243287 filed on Dec. 26, 2018, the entirety of which is incorporated by reference.

TECHNICAL FIELD

The disclosure relates to an impact tool such as an electric hammer and a hammer drill.

RELATED ART

An impact tool, such as an electric hammer and a hammer drill, ensures hammering operation by transforming rotation from a motor into forward and rearward movement of a piston with a crank mechanism or the like to indirectly hammer a rear end of a tip tool mounted on a tool holder via an intermediate element with an impact element that moves forward and rearward inside a cylinder or a tool holder in conjunction with the piston.

As the impact tool, the following impact tool has been known. The impact tool includes a no-load striking prevention mechanism such that the intermediate element is not stricken with the impact element, even though the piston is reciprocated in a state where the tip tool is not mounted on the tool holder and a state where the tip tool is not pushed against a surface to be processed (hereinafter, they are referred to as "non-striking state"). For example, Japanese Patent No. 3369844 discloses a locking O-ring disposed on a distal end of a cylinder, and a circular cone formed on an intermediate element. In the non-striking state, the locking O-ring is engaged with the circular cone of the intermediate element which has advanced with a first no-load striking compared with in a normal striking, which applies resistance to front-rear movement of the intermediate element. Thus, the intermediate element is restricted to move toward the impact element, thereby preventing the subsequent no-load striking.

However, in Japanese Patent No. 3369844, the O-ring as an elastic body directly performs the movement restriction on the intermediate element. Thus, the O-ring may be abraded or deteriorated by repeating contact with the intermediate element to reduce a resistive power applied to the intermediate element, thus possibly being less able to provide a no-load striking prevention function.

Therefore, it is an object of the disclosure to provide an impact tool configured to provide a stable no-load striking prevention function even though movement restriction of an intermediate element is ensured.

SUMMARY

In order to achieve the above-described object, there is provided an impact tool according to the disclosure. The impact tool is configured to include a tubular tool holder, a striking mechanism, a resistor, and a biasing member. The tool holder holds a tip tool. The striking mechanism is disposed inside the tool holder. The striking mechanism includes a piston, an impact element, and an intermediate element. The piston moves forward and rearward in accordance with rotation from a motor. The impact element moves forward and rearward in conjunction with the piston.

The intermediate element is housed movable back and forth between the impact element and the tip tool. The intermediate element abuts on a rear end of the tip tool to indirectly transmit a striking force from the impact element to the tip tool in a normal striking. The resistor is disposed on the tool holder. The resistor is configured to abut on at least one of the intermediate element and the tip tool to apply a resistance to a front-rear movement of at least one of the intermediate element and the tip tool in a non-striking state. The biasing member is disposed on the tool holder. The biasing member biases the resistor toward at least one of the intermediate element and the tip tool.

"Non-striking state" means a state where the tip tool is not mounted on the tool holder as described above and a state where the tip tool is not pushed against a surface to be processed even though the tip tool is mounted on the tool holder.

In the disclosure, the resistor is preferably disposed at a position where the resistor abuts on the intermediate element that has advanced in a no-load striking from a rear to restrict a rearward movement of the intermediate element.

The resistor is preferably made of metal.

The resistor preferably has a taper shape tapered off toward an inside of the tool holder.

The resistor preferably has a distal end on which a hemispherical portion is formed.

The resistor is preferably disposed with passing through the tool holder in a radial direction to be movable in the radial direction. The biasing member preferably projects and biases the resistor from an outer side to an inner side of the tool holder.

The biasing member is preferably a C-shaped leaf spring wound around the tool holder.

The resistor preferably abuts on the intermediate element. A resistor abutting portion having a diameter smaller than a diameter of a slidingly-contact portion guided by an inner peripheral surface of the tool holder is preferably formed on a rear portion of the intermediate element.

A non-guide surface without slidingly contacting the impact element that has advanced in a no-load striking is preferably formed on an inner peripheral surface of the tool holder.

An air vent hole is preferably formed with passing through the tool holder at a position of the non-guide surface. The air vent hole is preferably communicated from an inside to an outside of the tool holder.

A front end surface of the impact element and a rear end surface of the intermediate element preferably abut on one another when the impact element advances. The front end surface of the impact element and the rear end surface of the intermediate element preferably have curved convex surfaces bulging in a direction facing one another.

The resistor is preferably disposed at a position where the resistor abuts on a retaining groove of the tip tool that has advanced in a no-load striking to restrict a rearward movement of the tip tool.

The tool holder preferably has a distal end portion on which a ball is engaged with the retaining groove to retain the tip tool and prevent the tip tool from rotating. The resistor is preferably arranged ahead of the ball. The resistor is preferably positioned inside the retaining groove at a position where the ball abuts on a rear end of the retaining groove of the tip tool that has advanced in the no-load striking.

The resistor is preferably a metallic ball.

According to the disclosure, the resistor, which is configured to abut on the intermediate element and/or the tip tool to apply the resistance to its front-rear movement in the non-striking state, and the biasing member, which biases the resistor to a side of the intermediate element and/or the tip tool, are disposed on the tool holder. Thus, the disclosure is configured to reduce the momentum of the intermediate element and/or the tip tool that advances with the no-load striking to restrain bounce, thus preventing the subsequent no-load striking. The use of the biasing member separately from the resistor can eliminate the need to use an elastic material as the resistor, reducing possibility of abrasion and deterioration. Accordingly, even though the movement restriction of the intermediate element and/or the tip tool is ensured, stable no-load striking prevention function can be provided.

When the resistor is disposed at the position where the resistor abuts on the intermediate element that has advanced in the no-load striking from the rear to restrict the rearward movement of the intermediate element, the function to restrict the retreat of the intermediate element can be added to the resistor having the function to reduce the momentum of the intermediate element, thus more certainly ensuring the no-load striking prevention.

The metallic resistor eliminates the possibility of the abrasion and the deterioration to improve durability.

The resistor having the taper shape tapered off toward the inside of the tool holder facilitates setting of the projecting position toward the inside of the tool holder, and the resistor can be assembled to the tool holder regardless of directionality.

When the resistor is disposed with passing through the tool holder in the radial direction to be movable in this radial direction and the biasing member is configured to project and bias the resistor from an outer side to an inner side of the tool holder, the resistor can be easily projected and biased to the inside of the tool holder.

When the biasing member is the C-shaped leaf spring wound around the tool holder, the biasing member can be easily assembled to the tool holder.

When the resistor is considered as one abutting on the intermediate element and the resistor abutting portion having the diameter smaller than that of the slidingly-contact portion guided by the inner peripheral surface of the tool holder is formed on the back portion of the intermediate element, the resistance can be applied without making the resistor abut on the slidingly-contact portion.

When the non-guide surface is formed on the inner peripheral surface of the tool holder so as not to slidingly contact the impact element that has advanced in the no-load striking, the impact element is moved with the first striking and located inside with respect to the non-guide surface. As a result, the impact element becomes likely to be inclined from the axis line of advancing and retreating movement in the normal striking. Thus, the striking force of the first no-load striking against the intermediate element can be weakened to reduce the momentum of the forward movement of the intermediate element. Accordingly, the certain no-load striking prevention is ensured.

When the front end surface of the impact element and the rear end surface of the intermediate element that abut on one another have the curved convex surfaces bulging in a direction facing one another, even though the slight inclination occurs on the impact element, appropriate abutment of the front shaft portion on the rear shaft portion is ensured, thus not applying an excessive load to the intermediate element.

When the resistor is disposed at the position where the resistor abuts on the retaining groove of the tip tool that has advanced in the no-load striking to restrict the rearward movement of the tip tool, the resistance can be easily applied to the tip tool using the retaining groove, thus ensuring effective no-load striking prevention.

DETAILED DESCRIPTION

The following describes embodiments of the disclosure based on the drawings.

Figure 1:
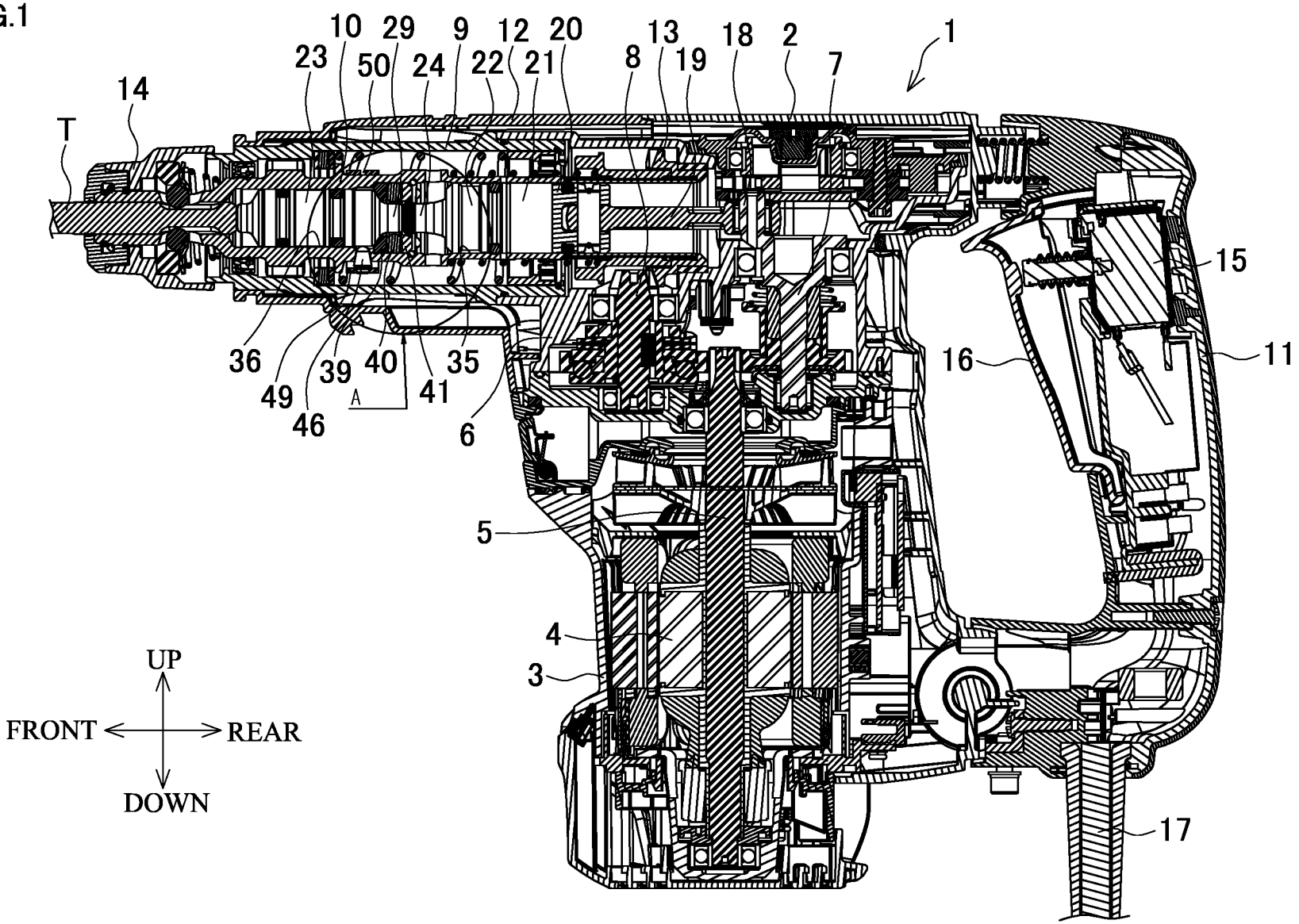
FIG. 1 is a center vertical cross-sectional view of a hammer drill (in normal striking).

FIG. 1 is a center vertical cross-sectional view illustrating an exemplary hammer drill 1 as an impact tool.

In the hammer drill 1, a motor housing 3, which houses a motor 4 with an output shaft 5 disposed upward, is coupled to a front lower portion of a main body housing 2 in an up and down direction. Above the motor housing 3, the hammer drill 1 internally includes a gear housing 6 that houses a crankshaft 7 and an intermediate shaft 8 each engaged with the output shaft 5. A front housing 9, which houses a tubular tool holder 10 disposed forward, is assembled on a front side of the gear housing 6. A handle housing 11 is coupled to a back portion of the main body housing 2. A housing cover 12, which covers the front housing 9, is coupled to a front portion of the main body housing 2.

The intermediate shaft 8 is engaged with a bevel gear 13 disposed on a rear end of the tool holder 10. A tip tool T such as a drill bit is mountable on a distal end of the tool holder 10 with an operation sleeve 14. The handle housing 11 includes a switch 15 and a switch lever 16. A power supply cord 17 is connected to a lower portion of the handle housing 11.

Figure 2:
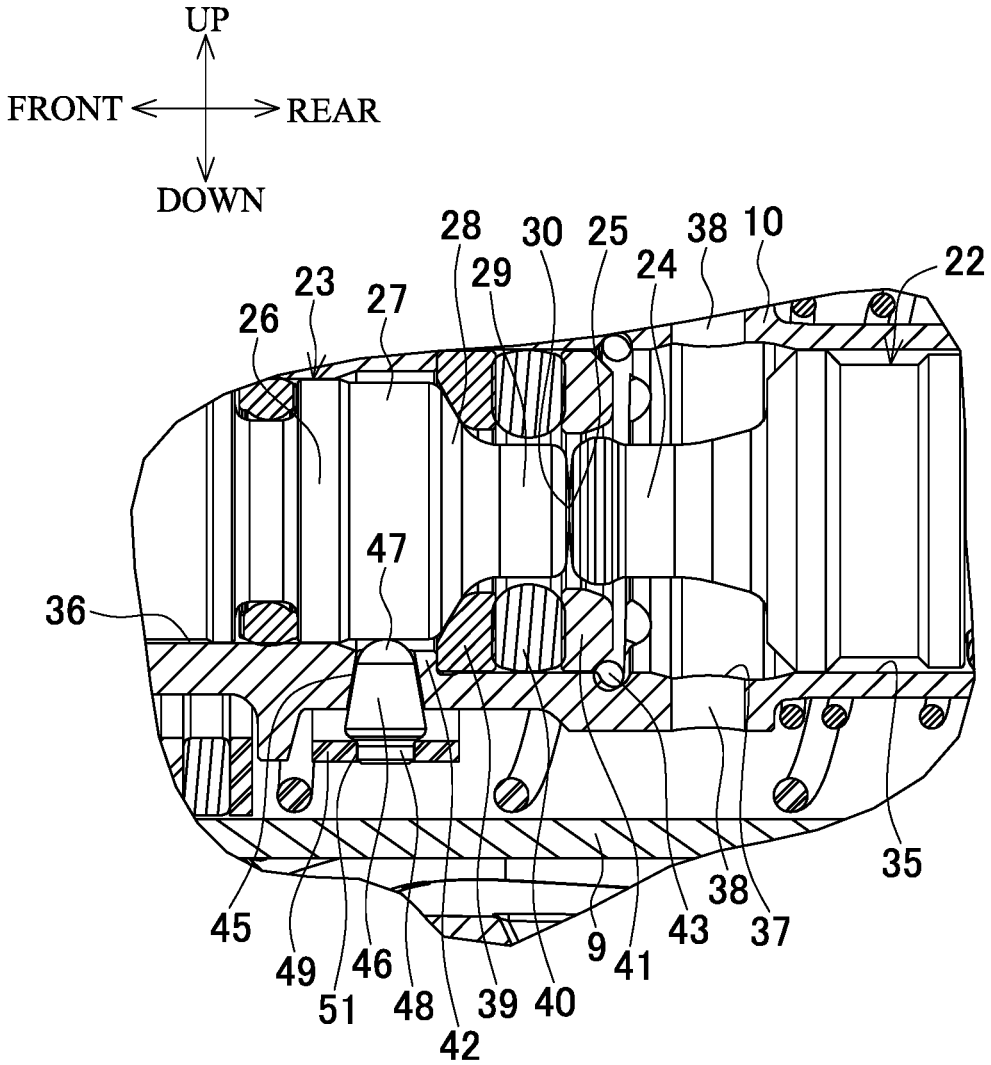
FIG. 2 is an enlarged view of A part in FIG. 1.

The tool holder 10 internally includes a piston 20 that is reciprocated with being coupled to an eccentric pin 18 of the crankshaft 7 via a coupling rod 19. A striker (impact element) 22 is housed via an air chamber 21 ahead of the piston 20, and an intermediate element 23 is housed ahead of the striker 22, thus forming a striking mechanism. As illustrated in FIG. 2, the striker 22 has a front shaft portion 24 projecting forward at a center of a front portion. The front shaft portion 24 has a front surface that is a spherical surface 25 as a convex surface slightly bulging forward.

The intermediate element 23 has an intermediate portion that is a slidingly-contact portion 26 having a large diameter, which is guided by a front guide surface 36 described later. The intermediate element 23 has a rear portion that is a pin abutting portion 27 as a resistor abutting portion having a diameter smaller than that of the slidingly-contact portion 26. The pin abutting portion 27 has a rear portion that is a tapered portion 28 having a diameter gradually decreasing rearward. The tapered portion 28 has a center on which a rear shaft portion 29 projecting rearward is formed. The rear shaft portion 29 has a rear surface that is a spherical surface 30 as a convex surface slightly projecting rearward.

The tool holder 10 includes a rear guide surface 35 and the front guide surface 36 are each formed on its inner peripheral surface. The rear guide surface 35 houses the piston 20 and the striker 22. The front guide surface 36 houses the intermediate element 23 and has a diameter smaller than that of the rear guide surface 35. A non-guide surface 37 is partially disposed ahead of an advance position of the striker 22 in normal striking on the rear guide surface 35. The non-guide surface 37 has a diameter larger than an inner diameter of the rear guide surface 35 and does not contact an outer peripheral surface of the striker 22 that has advanced in no-load striking. Air vent holes 38, 38, which communicate the inside with the outside of the tool holder 10, are formed with passing through the tool holder 10 at a position of the non-guide surface 37.

Further, a front receiving ring 39, through which the rear shaft portion 29 of the intermediate element 23 passes to receive a rear surface of the intermediate element 23, is disposed on a front end of the rear guide surface 35 inside the tool holder 10. A gripping ring 40, which grips the front shaft portion 24 of the striker 22 when the striker 22 advances with the no-load striking, is disposed at the rear of the front receiving ring 39. A rear receiving ring 41 through which the front shaft portion 24 passes to receive a front surface of the striker 22 is disposed at the rear of the gripping ring 40.

The front receiving ring 39, gripping ring 40, and rear receiving ring 41 are positioned from front to rear. In a state where the front receiving ring 39 abuts on a stepped portion 42 formed between the rear guide surface 35 and the front guide surface 36 to restrict its forward movement, the gripping ring 40 and the rear receiving ring 41 are housed in this order. The retreat of the rear receiving ring 41 is restricted by a locking ring 43 locked to the rear guide surface 35.

Figure 3:
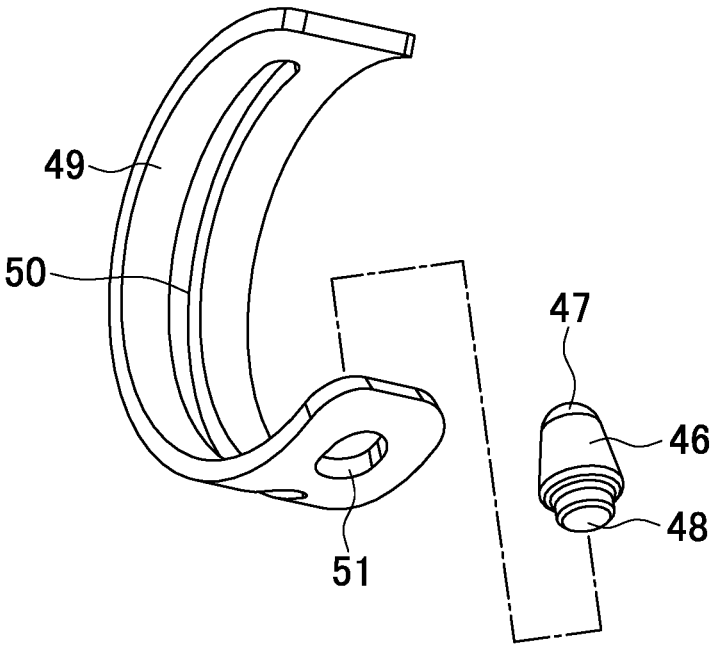
FIG. 3 is a perspective view of a resistance pin and a leaf spring.

A through-hole 45 having a taper shape tapered off from the outside toward the inside in a radial direction is formed in the radial direction at a rear end position of the front guide surface 36 on the tool holder 10. A resistance pin 46 as a resistor is inserted into the through-hole 45. As illustrated in FIG. 3, the resistance pin 46 is a metallic shaft body formed into a taper shape that is tapered off in accordance with the through-hole 45. A hemispherical portion 47 is continuously formed on a distal end, which is tapered off, of the resistance pin 46, while a protrusion portion 48 having a small diameter is formed on a base end side of the resistance pin 46. The protrusion portion 48 axially has a constant diameter.

A leaf spring 49 as a biasing member is externally mounted on an outer periphery of the tool holder 10 at a position of the resistance pin 46. The leaf spring 49 is made such that a strip-shaped metal plate is folded into a C shape. A slit 50 is formed on a center in a width direction of the leaf spring 49 excluding both ends in a longitudinal direction. A through hole 51 is formed on one end part portion of the leaf spring 49.

Figure 5:
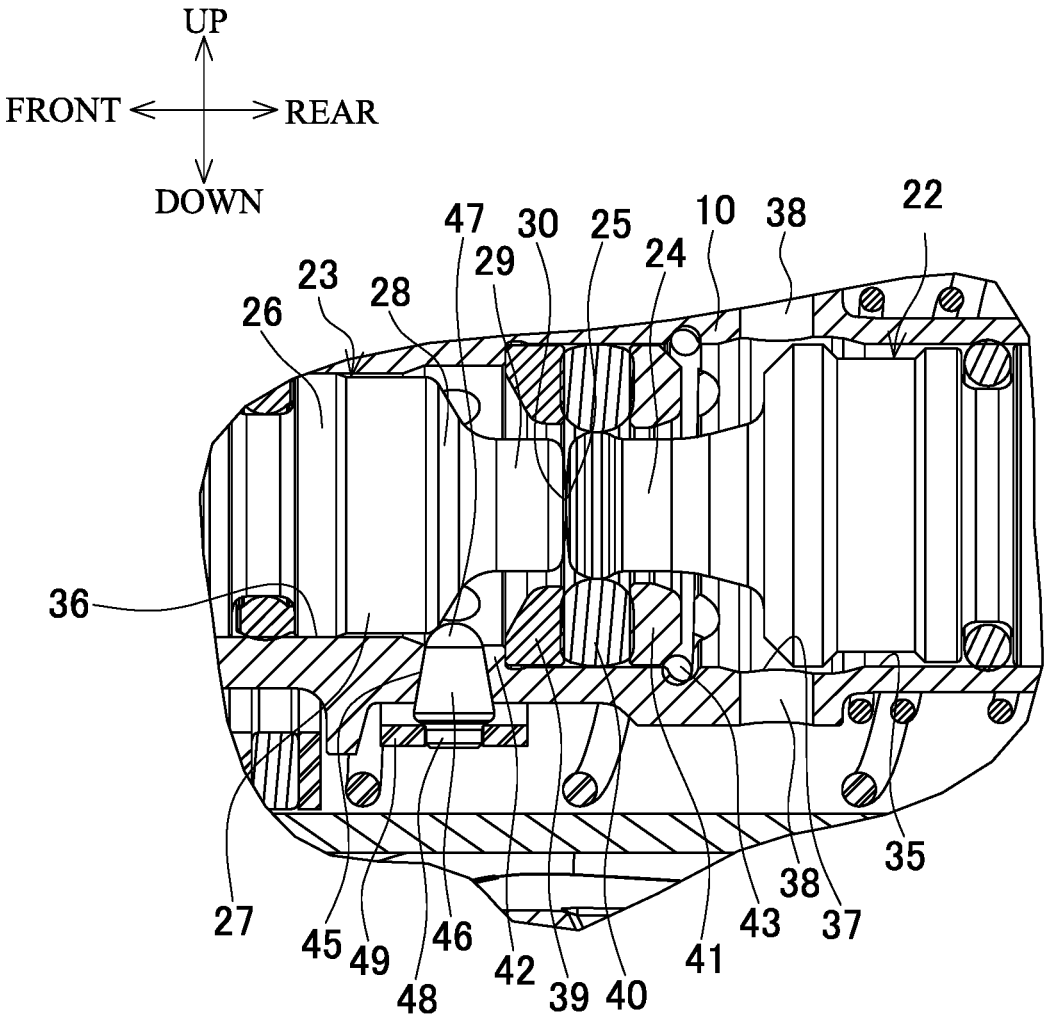
FIG. 5 is an enlarged view of A part in FIG. 4.

In state where the resistance pin 46 has been inserted into the through-hole 45 from the hemispherical portion 47, the leaf spring 49 is externally mounted on the outer periphery of the tool holder 10 with the protrusion portion 48 of the resistance pin 46 having been inserted into the through hole 51. Accordingly, due to an elasticity of the leaf spring 49, the resistance pin 46 is pushed axially inward of the tool holder 10 and biased to a projecting position where the hemispherical portion 47 is projected inward from the through-hole 45. In a state where the resistance pin 46 does not abut on the pin abutting portion 27 of the intermediate element 23, as illustrated in FIG. 5, a distal end of the hemispherical portion 47 projects axially inward of the tool holder 10 with respect to an outer peripheral surface of the pin abutting portion 27 of the intermediate element 23.

In the hammer drill 1 configured as described above, with a change lever (not illustrated) disposed on a left side surface of the main body housing 2, it is possible to select a hammer mode that rotates the crankshaft 7 to strike the tip tool T, a drill mode that rotates the intermediate shaft 8 to rotate the tip tool T together with the tool holder 10, and a hammer drill mode that simultaneously operates the crankshaft 7 and the intermediate shaft 8 to strike and rotate the tip tool T.

Here, the tip tool T is inserted and mounted from the distal end of the tool holder 10. When a distal end of the tip tool T is pushed against the surface to be processed, the tip tool T is pushed to retreat the intermediate element 23. Subsequently, the intermediate element 23 abuts on the front receiving ring 39, and thus, the push is restricted at a retreated position where the rear shaft portion 29 is projected inside the rear receiving ring 41. When the intermediate element 23 retreats, the hemispherical portion 47, which is projecting inside the tool holder 10, of the resistance pin 46 abuts on the tapered portion 28. The hemispherical portion 47 in the abutting state relatively moves to an outer peripheral side of the tapered portion 28 directly as the intermediate element 23 retreats, thus retreating the resistance pin 46 outside in the radial direction inside the through-hole 45 against the bias of the leaf spring 49. When the resistance pin 46 is positioned at the retreated position of the intermediate element 23, the hemispherical portion 47 is pushed against the outer periphery of the pin abutting portion 27 as illustrated in FIGS. 1 and 2.

Next, when a push-in operation is performed on the switch lever 16 to turn on the switch 15 in a state where the hammer mode or the hammer drill mode is selected with the change lever, the motor 4 is driven to rotate the output shaft 5, thus rotating the crankshaft 7. Accordingly, eccentric motion of the eccentric pin 18 moves the piston 20 forward and rearward via the coupling rod 19 to move the striker 22 forward and rearward via the air chamber 21. Thus, the front shaft portion 24 of the striker 22 strikes the rear shaft portion 29 of the intermediate element 23 inside the rear receiving ring 41. Consequently, the tip tool T is indirectly stricken by the striker 22 via the intermediate element 23 to enable the tip tool T to, for example, cut the surface to be processed.

Figure 4:
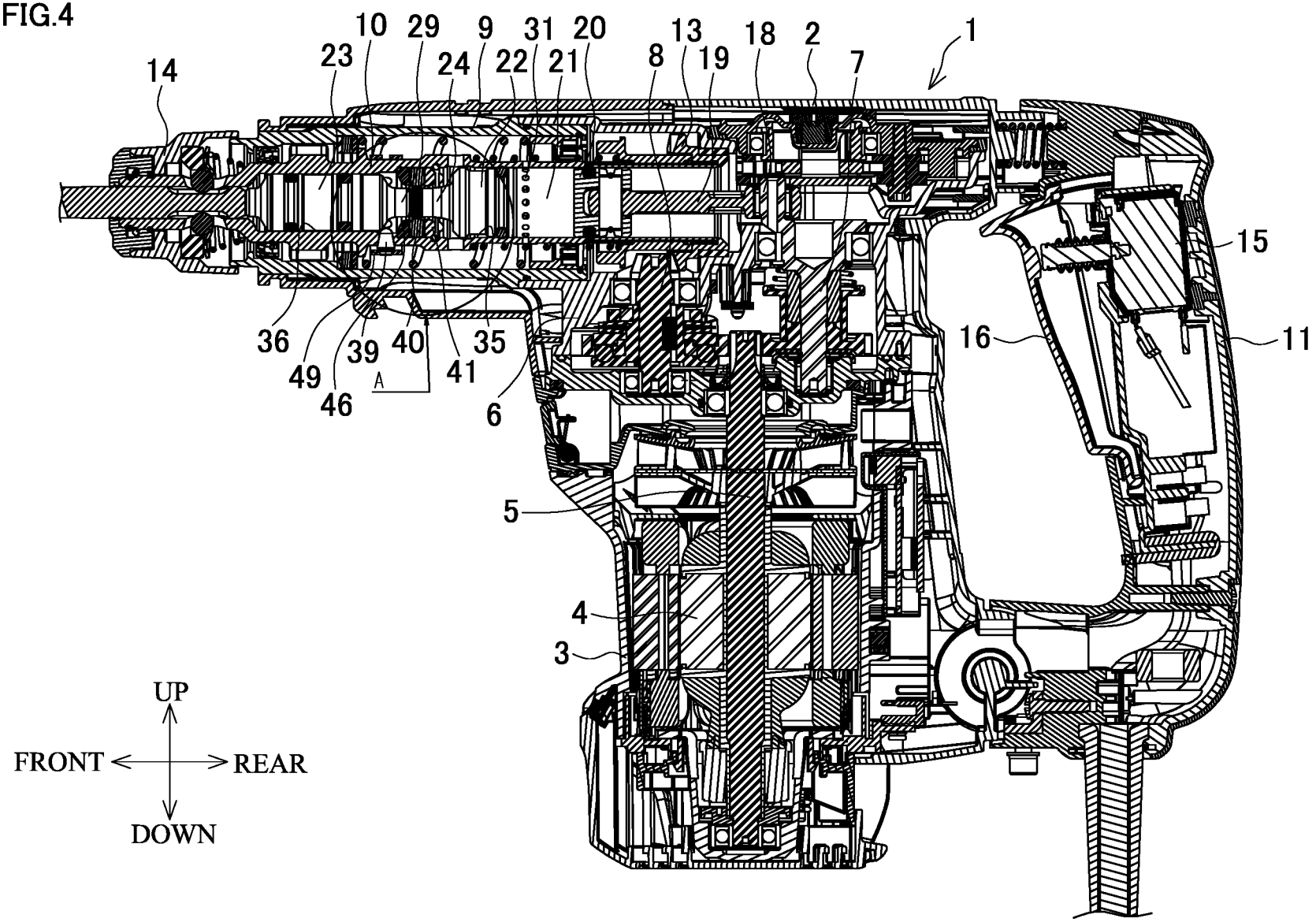
FIG. 4 is a center vertical cross-sectional view of the hammer drill (in a no-striking state).

On the other hand, when the push-in operation is performed on the switch lever 16 in a non-striking state where the tip tool T is not pushed against the surface to be processed (or the tip tool T is not mounted on the tool holder 10), as illustrated in FIGS. 4 and 5, first striking (no-load striking) by the striker 22 will move the intermediate element 23 forward from the retreated position. At this time, the intermediate element 23 advances in a state where the pin abutting portion 27 is pushed by the resistance pin 46 from an outside in the radial direction to receive the resistance. Thus, momentum of the forward movement is reduced to decrease a bounce after a front end of the intermediate element 23 collides against a front-side inner surface of the tool holder 10. Even if the intermediate element 23 bounces, the hemispherical portion 47 of the resistance pin 46, which has returned to the projecting position as the intermediate element 23 advances, is engaged with a peripheral edge of the tapered portion 28 from the rear. Thus, the intermediate element 23 is restricted from retreating here, and does not return to the retreated position. Therefore, the subsequent no-load striking is prevented.

The striker 22 that has advanced with the first no-load striking advances to a position where a distal end of the front shaft portion 24 reaches the inside of the gripping ring 40. Here, a plurality of ventilation holes 31, 31 . . . (FIG. 4) that are opened by the forward movement of the striker 22 are circumferentially formed on the tool holder 10. The air chamber 21 is communicated with the outside of the tool holder 10, thus losing action of air spring. Accordingly, the striker 22 is held at a position where the front end of the front shaft portion 24 is fitted to the gripping ring 40, and conjunction with the piston 20 of the striker 22 is cut off.

Further, the non-guide surface 37 having a diameter larger than that of the striker 22 is formed on the rear guide surface 35 of the tool holder 10. When the striker 22 advances with the first no-load striking, the striker 22 moves to locate inside with respect to the non-guide surface 37, thereby losing forward movement guide by the rear guide surface 35. Thus, the striker 22 becomes likely to be inclined from an axis line of the forward and rearward movement in the normal striking, weakening striking force itself with the first no-load striking against the intermediate element 23. The spherical surfaces 25 and 30 each bulging in a direction facing one another are formed on the front end surface of the front shaft portion 24 of the striker 22 and the rear end surface of the rear shaft portion 29 of the intermediate element 23. Thus, even though the slight inclination occurs on the striker 22, appropriate abutment of the front shaft portion 24 on the rear shaft portion 29 is ensured.

With the hammer drill 1 as described above, the resistance pin 46 (resistor), which is configured to abut on the intermediate element 23 in the non-striking state to apply the resistance to the front-rear movement of the intermediate element 23, and the leaf spring 49 (biasing member), which biases the resistance pin 46 to a side of the intermediate element 23, are disposed on the tool holder 10. When the intermediate element 23 advances with the no-load striking, the resistance pin 46 and the leaf spring 49 cause the intermediate element 23 to restrain its bouncing action by reducing the momentum, thus preventing the subsequent no-load striking. The use of the leaf spring 49 for biasing separately from the resistance pin 46 can eliminate the need to use an elastic material as the resistance pin 46, thus reducing possibility of abrasion and deterioration. Accordingly, even though the movement restriction of the intermediate element 23 is ensured, stable no-load striking prevention function can be provided.

Especially here, the resistance pin 46 is disposed at a position where the resistance pin 46 abuts on the intermediate element 23 that has advanced in the no-load striking from the rear to restrict the rearward movement of the intermediate element 23. Therefore, the function to restrict the retreat of the intermediate element 23 can be added to the resistance pin 46 having the function to reduce the momentum of the intermediate element 23, thus more certainly ensuring the no-load striking prevention.

The metallic resistance pin 46 eliminates the possibility of the abrasion and the deterioration to improve durability.

Furthermore, the resistance pin 46 having the taper shape tapered off toward the inside of the tool holder 10 facilitates setting of the projecting position to the inside of the tool holder 10 and can be assembled to the tool holder 10 regardless of directionality.

In addition, the resistance pin 46 is disposed with passing through the tool holder 10 in the radial direction to be movable in this radial direction. The leaf spring 49 is configured to project and bias the resistance pin 46 from an outer side to an inner side of the tool holder 10, which allows to easily project and bias the resistance pin 46 to the inside of the tool holder 10.

The biasing member is the C-shaped leaf spring 49 wound around the tool holder 10, thus being easily assembled to the tool holder 10.

Furthermore, the pin abutting portion 27 having the diameter smaller than that of the slidingly-contact portion 26 guided by the front guide surface 36 of the tool holder 10 is formed on the back portion of the intermediate element 23. Thus, the resistance can be applied without making the resistance pin 46 abut on the slidingly-contact portion 26.

The non-guide surface 37 with which the striker 22 that has advanced in the no-load striking does not slidingly contact is formed on the inner peripheral surface of the tool holder 10. The striker 22 moves with the first no-load striking to locate inside with respect to the non-guide surface 37. As a result, the striker 22 becomes likely to be inclined from the axis line of the forward and rearward movement in the normal striking by moving with the first no-load striking to locate inside with respect to the non-guide surface 37. Accordingly, the striking force of the first no-load striking against the intermediate element 23 can be weakened to reduce the momentum of the forward movement of the intermediate element 23. Consequently, the certain no-load striking prevention is ensured.

Further, the spherical surfaces 25 and 30 bulging in the direction facing one another are formed on the front end surface of the striker 22 and the rear end surface of the intermediate element 23 that abut on one another when the striker 22 advances. Thus, even though the slight inclination occurs on the striker 22, appropriate abutment of the front shaft portion 24 on the rear shaft portion 29 is ensured, thus not applying an excessive load to the intermediate element 23.

The shape of the resistance pin is not limited to the taper shape in the above-described configuration, and can be changed as necessary such as having a constant diameter over the whole length in the axial direction. The resistor is not limited to have the pin shape, and for example, a ball and a roller can be employed. The number of resistors is not limited to one, and a plurality of resistors may be concentrically arranged on the tool holder. Furthermore, the resistor is allowed to be formed long in the circumferential direction of the tool holder to increase a contacted area with the intermediate element. As the material of the resistor, for example, ceramic and hard resin can be employed other than the metal.

In addition, the biasing member is not limited to the leaf spring, and for example, a wire wound around the tool holder and a plate spring that is not wound around the tool holder can be employed. The biasing member may be housed in a depressed groove formed on the outer periphery of the tool holder.

In the above-described configuration, the resistor abutting portion having the small diameter is formed on the rear portion of the intermediate element, but the resistor may abut on the slidingly-contact portion without the resistor abutting portion. The non-guide surface disposed on the inner peripheral surface of the tool holder also can be omitted. The curved convex surfaces formed on the front end surface of the striker and the rear end surface of the intermediate element may be, for example, not only directional curved convex surfaces, but also the spherical surfaces without the directionality, and need not be the curved convex surfaces.

In the above-described configuration, the resistor that applies the resistance to the intermediate element is disposed, but a resistor that applies the resistance to the tip tool may be disposed.

Figure 6:
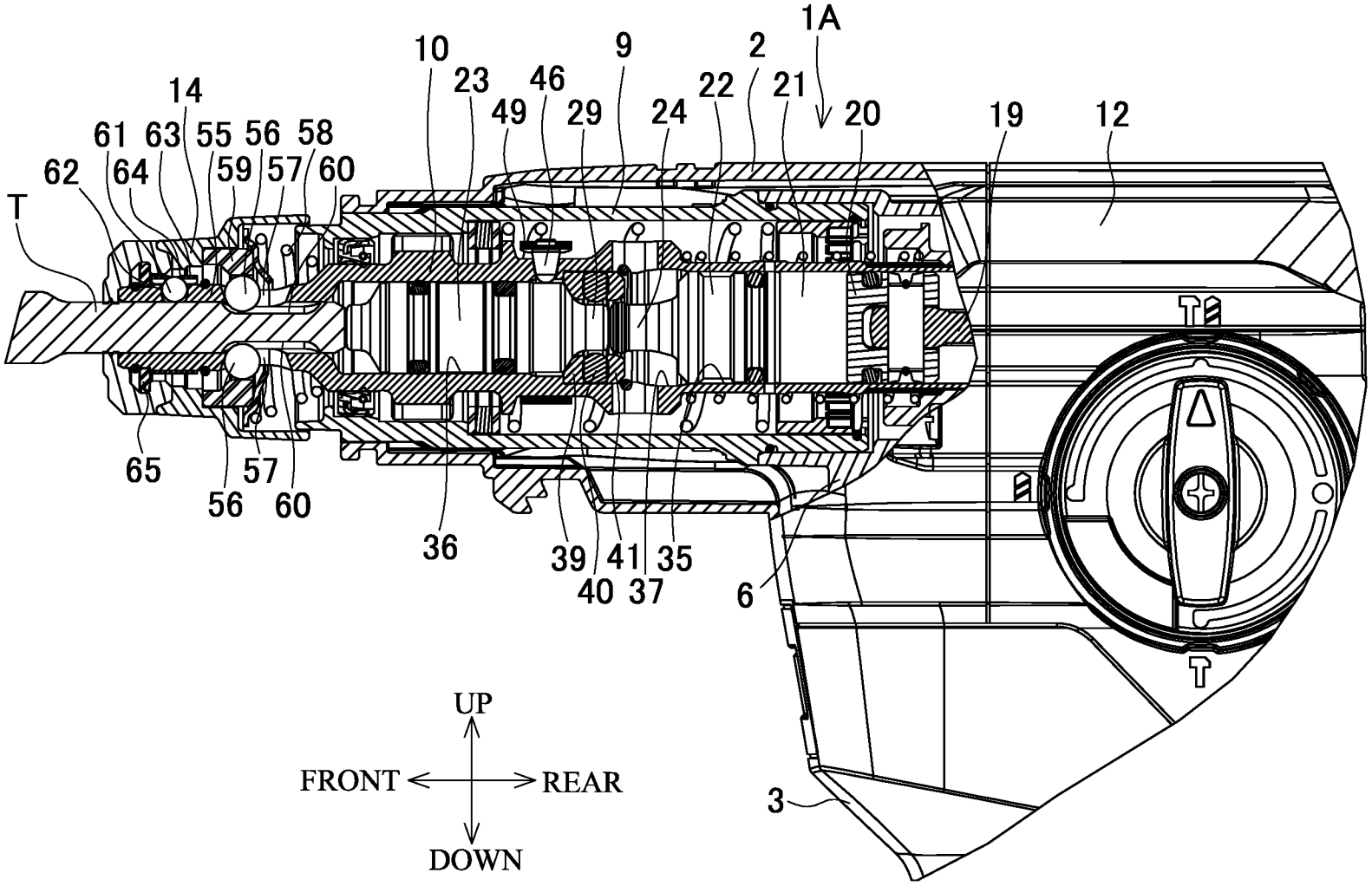
FIG. 6 is a partially center vertical cross-sectional view of a hammer drill in a modification example (in the normal striking).

FIG. 6 illustrates a hammer drill 1A according to the modification example. First, a pair of balls 56, 56 are disposed on a distal end portion 55 of the tool holder 10 inside the operation sleeve 14. The balls 56, 56 are held in elongate holes 57, 57 drilled in the radial direction up to the distal end portion 55 with being configured to appear to an axial center of the distal end portion 55. The balls 56, 56 are pushed to the projecting position toward the axial center by a lock ring 59 inside the operation sleeve 14. The lock ring 59 is biased to an advance position by a coil spring 58. Accordingly, the balls 56, 56 are engaged with a pair of retaining grooves 60, 60 provided in a front-rear direction on the outer periphery of the tip tool T to retain the tip tool T and prevent the tip tool T from rotating with respect to the distal end portion 55. When the operation sleeve 14 is retreated against the biasing of coil spring 58, the lock ring 59 also retreats to release the push to the balls 56, 56, thus enabling the tip tool T to be inserted and removed.

Figure 7:
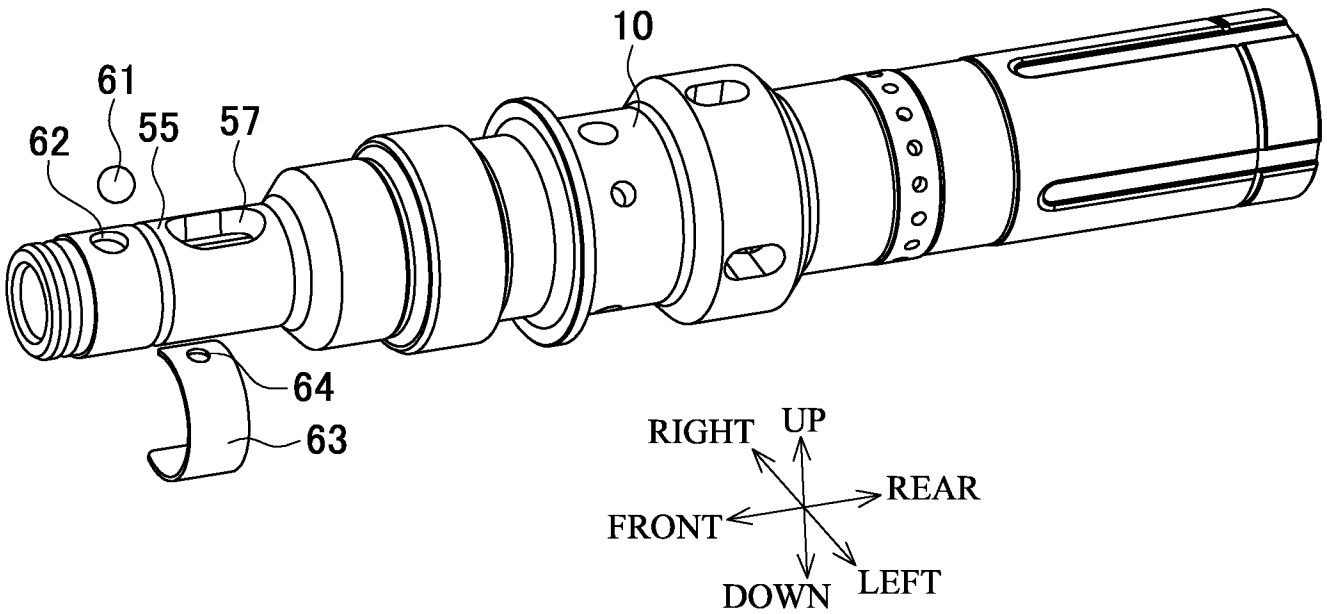
FIG. 7 is a perspective view of a tool holder, a resistance ball, and the leaf spring.

In the distal end portion 55, a metallic resistance ball 61 as a resistor having a diameter smaller than that of the ball 56 is disposed ahead of the upper ball 56. The resistance ball 61 is configured to appear to the axial center via a through hole 62 drilled in the radial direction up to the distal end portion 55. As also illustrated in FIG. 7, a C-shaped leaf spring 63 is externally mounted on the outer periphery of the distal end portion 55 at a position of the resistance ball 61. In this externally mounted state, a small hole 64 provided on an end portion of the leaf spring 63 is fitted to the resistance ball 61 from the outside to push the resistance ball 61 to a projecting position partially projecting from the through hole 62 to the axial center. Accordingly, in the normal striking illustrated in FIG. 6, the resistance ball 61 abutting on the outer peripheral surface of the inserted tip tool T retreats outside in the radial direction against the biasing of the leaf spring 63, pushing the tip tool T with constantly applying the resistance. A washer 65 is externally mounted on a front side of the leaf spring 63 to restrict the forward movement of the leaf spring 63.

Figure 8:
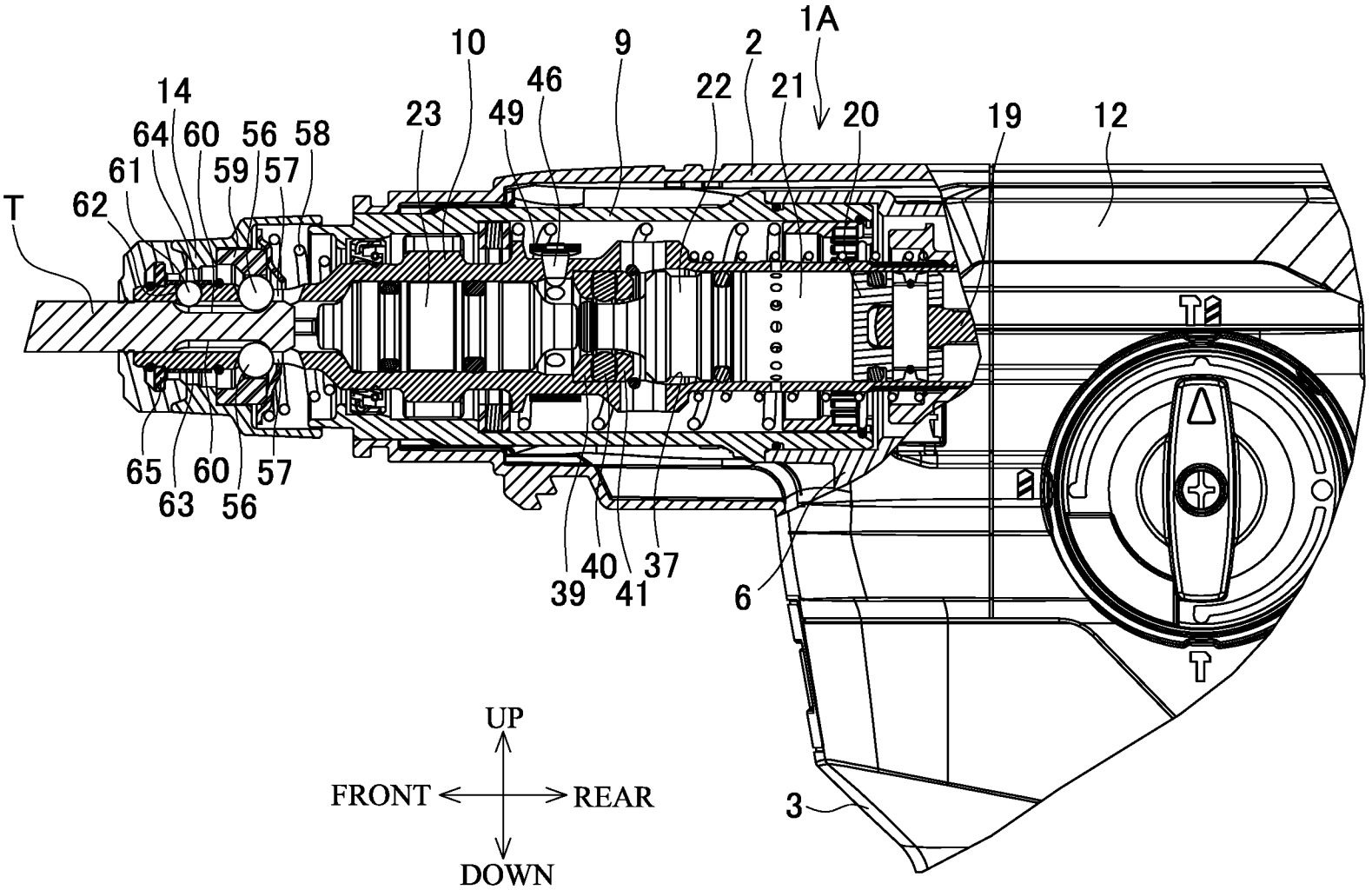
FIG. 8 is a partially center vertical cross-sectional view of the hammer drill in the modification example (in the no-striking state).

On the other hand, when the push-in operation is performed on the switch lever 16 in the non-striking state where the tip tool T is not pushed against the surface to be processed, as illustrated in FIG. 8, the first striking (no-load striking) with the striker 22 moves the intermediate element 23 forward from the retreated position and also moves the tip tool T forward. At this time, the tip tool T advances in a state where the resistance is applied by the resistance ball 61. Thus, the momentum of the forward movement is reduced, and the bounce after the balls 56, 56 collide with rear ends of the retaining grooves 60, 60 as in FIG. 8 reduces. Even if the balls 56, 56 bounce, at the position where the balls 56, 56 abut on the rear ends of the retaining grooves 60, 60, the resistance ball 61 relatively moves to the front end of the retaining groove 60 to return to the projecting position. Accordingly, the resistance ball 61 is engaged with the front end of the retaining groove 60 from the rear, so that the retreat of the tip tool T is elastically restricted here and the tip tool T does not return to the retreated position. Therefore, the subsequent no-load striking is prevented.

Further, in the hammer drill 1A in the above-described modification example, the resistance ball 61 (resistor), which is configured to abut on the tip tool T in the non-striking state to apply the resistance to the front-rear move of the tip tool T, and the leaf spring 63 (biasing member), which biases the resistance ball 61 to a side of the tip tool T, are disposed on the tool holder 10. Thus, the momentum of the tip tool T that advances with the no-load striking can be reduced to restrain the bounce, thereby preventing the subsequent no-load striking.

Especially here, the resistance ball 61 is disposed at a position where the resistance ball 61 abuts on the retaining groove 60 of the tip tool T that has advanced in the no-load striking to restrict the rearward movement of the tip tool T. Thus, the resistance can be easily applied to the tip tool T using the retaining groove 60, ensuring effective no-load striking prevention.

In above-described modification example, the ball is employed as the resistor. However, a roller that is formed long in a front-rear direction may be employed, or a pin shape as in the prior form may be employed.

Here as well, the number of resistors is not limited to one, and a plurality of resistors may be concentrically disposed on the distal end portion. As the material of the resistor as well, for example, the ceramic and the hard resin can be employed other than the metal.

Furthermore, the biasing member is also not limited to the leaf spring, and for example, a wire wound around the distal end portion and a plate spring that is not wound around the distal end portion can be employed. The biasing member may be housed in a depressed groove formed on the outer periphery of the distal end portion.

In the above-described modification example, respective resistors are disposed on a side of the intermediate element and a side of the tip tool to enhance a no-load striking prevention effect. However, insofar as a desired no-load striking prevention effect is obtained, the resistor is allowed to be disposed on only the tip tool side without the resistor on the intermediate element side.

Besides, commonly in the above-described configuration and modification example, for the structure of the hammer drill as well, the resistor and the biasing member can be employed, even though the striking mechanism has a structure where an arm is swingably disposed on a boss sleeve provided on an intermediate shaft parallel to the tool holder via a swash bearing whose axis line is inclined such that a piston cylinder coupled to the arm is moved forward and rearward. An orientation and a type of the motor are not limited to those in the above-described configuration. A DC machine on which a battery pack is mounted may be employed not an AC machine.

Furthermore, the impact tool is not limited to the hammer drill, and an electric hammer including only the striking mechanism is also applicable to the disclosure.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An impact tool comprising:

a tool holder that is configured to hold a tip tool;

a striking mechanism inside the tool holder, the striking mechanism including:

a piston that is configured to move forward and rearward relative to the tool holder in accordance with rotation from a motor;

an impact element that is configured to move forward and rearward in conjunction with the piston; and an intermediate element that is configured to (1) move back and forth between the impact element and the tip tool and (2) abut a rear end of the tip tool to indirectly transmit a striking force from the impact element to the tip tool in a normal striking;

a resistor that is configured to abut at least one of the intermediate element and the tip tool to apply a resistance to a front to rear movement of the at least one of the intermediate element and the tip tool in a non-striking state; and a biasing member that is configured to bias the resistor toward the at least one of the intermediate element and the tip tool at all times.

2. The impact tool according to claim 1, wherein the resistor is configured to abut the intermediate element when the intermediate element advances in a no-load striking to restrict a rearward movement of the intermediate element.

3. The impact tool according to claim 1, wherein the resistor is made of metal.

4. The impact tool according to claim 1, wherein the resistor has a taper shape tapered off toward an inside of the tool holder.

5. The impact tool according to claim 4, wherein the resistor has a distal end on which a hemispherical portion is formed.

6. The impact tool according to claim 1, wherein the resistor passing through the tool holder in a radial direction is movable in the radial direction, and the biasing member is configured to project and bias the resistor from an outer side to an inner side of the tool holder.

7. The impact tool according to claim 6, wherein the biasing member is a C-shaped leaf spring around the tool holder.

8. The impact tool according to claim 1, wherein the resistor abuts the intermediate element, the intermediate element includes (1) a resistor abutting portion having a first diameter on a rear portion of the intermediate element and (2) a slidingly-contact portion having a second diameter and guided by an inner peripheral surface of the tool holder, and the first diameter is smaller than the second diameter.

9. The impact tool according to claim 1, wherein an inner peripheral surface of the tool holder includes a non-guide surface without slidingly contacting the impact element that has advanced in a no-load striking.

10. The impact tool according to claim 9, wherein the tool holder includes an air vent hole in the non-guide surface, and the air vent hole is communicated from an inside to an outside of the tool holder.

11. The impact tool according to claim 9, wherein a front end surface of the impact element and a rear end surface of the intermediate element abut when the impact element advances, and the front end surface of the impact element and the rear end surface of the intermediate element have curved convex surfaces in a direction facing one another.

12. The impact tool according to claim 1, wherein the resistor configured to abut a retaining groove of the tip tool that has advanced in a no-load striking to restrict a rearward movement of the tip tool.

13. The impact tool according to claim 12, wherein the tool holder has a distal end portion on which a ball is disposed to engage with the retaining groove to retain the tip tool and prevent the tip tool from rotating, and the resistor arranged ahead of the ball is positioned inside the retaining groove at a position where the ball abuts on a rear end of the retaining groove of the tip tool that has advanced in the no-load striking.

14. The impact tool according to claim 12, wherein the resistor is a metallic ball.

15. The impact tool according to claim 1, wherein:

the intermediate tool has a first outer circumference, the tip tool has a second outer circumference, and the resistor is configured to abut the first outer circumference or the second outer circumference or the second outer circumference is a radial direction.

16. The impact tool according to claim 15, wherein the biasing member is configured to apply a biasing force on the resistor in the radial direction.

17. The impact tool according to claim 16, wherein the resistor passes through the tool holder.

18. The impact tool according to claim 17, wherein the biasing member encompasses the tool holder.

19. The impact tool according to claim 1, wherein the resistance is a force applied by the resistor transverse to forward and rearward directions.

20. The impact tool according to claim 19, wherein the biasing member encompasses the tool holder.

* * * * *